United States Patent [19]

Jackson

[11] 4,167,243

[45] Sep. 11, 1979

[54] SCROLL DISCHARGE DECANTER CENTRIFUGES

[75] Inventor: Joseph F. Jackson, Halifax, England

[73] Assignee: Thomas Broadbent & Sons Limited, Huddersfield, England

[21] Appl. No.: 834,595

[22] Filed: Sep. 19, 1977

[30] Foreign Application Priority Data

Sep. 22, 1976 [GB] United Kingdom ..... 39189/76

[51] Int. Cl.[2] ..... B04B 3/04

[52] U.S. Cl. ..... 233/7; 233/1 A; 277/59; 277/DIG. 5

[58] Field of Search ..... 233/1 R, 7, 1 A; 277/173, 174, 175, 176, 59, 135, 3, DIG. 1, DIG. 5

[56] References Cited

U.S. PATENT DOCUMENTS

| | | | |
|---|---|---|---|
| 2,809,854 | 10/1957 | McGahan | 277/173 X |
| 3,315,882 | 4/1967 | Reed | 233/7 |
| 3,377,073 | 4/1968 | Harney | 277/173 X |
| 3,601,307 | 8/1971 | Shapiro | 233/1 |
| 3,926,442 | 12/1975 | Muller | 277/3 |
| 3,947,044 | 3/1976 | Friedrich | 277/3 |

*Primary Examiner*—George H. Krizmanich

*Attorney, Agent, or Firm*—Beveridge, DeGrandi, Kline & Lunsford

[57] ABSTRACT

The invention concerns scroll discharge decanter centrifuges of the type in which the interior of the centrifuge is to be kept sealed from the atmosphere and which comprise a stationary assembly which includes an outer casing, a rotary assembly which includes a solid bowl which is adapted to be rotated within the stationary casing at a first speed and a scroll conveyor which is rotatable within the bowl at a second, slightly different speed. A plurality of sealing devices are arranged to be effective between the rotary assembly and the stationary assembly. Each sealing device comprises a first ring fixed relative to the stationary assembly and a second, coaxial ring which is adapted to rotate with the rotary assembly. That surface of the first ring which faces the second ring contains a plurality of gas jet nozzles by way of which pressurized gas can be supplied to an annular clearance gap between the first and second rings. One of the rings of each bearing is sealed by means of one or more elastomeric seals to a further annular member which is stationary relative to that one ring such that that ring is permitted to have a predetermined amount of radial and angular freedom relative to the further annular member for accommodating misalignment between the rotary and stationary assemblies.

7 Claims, 5 Drawing Figures

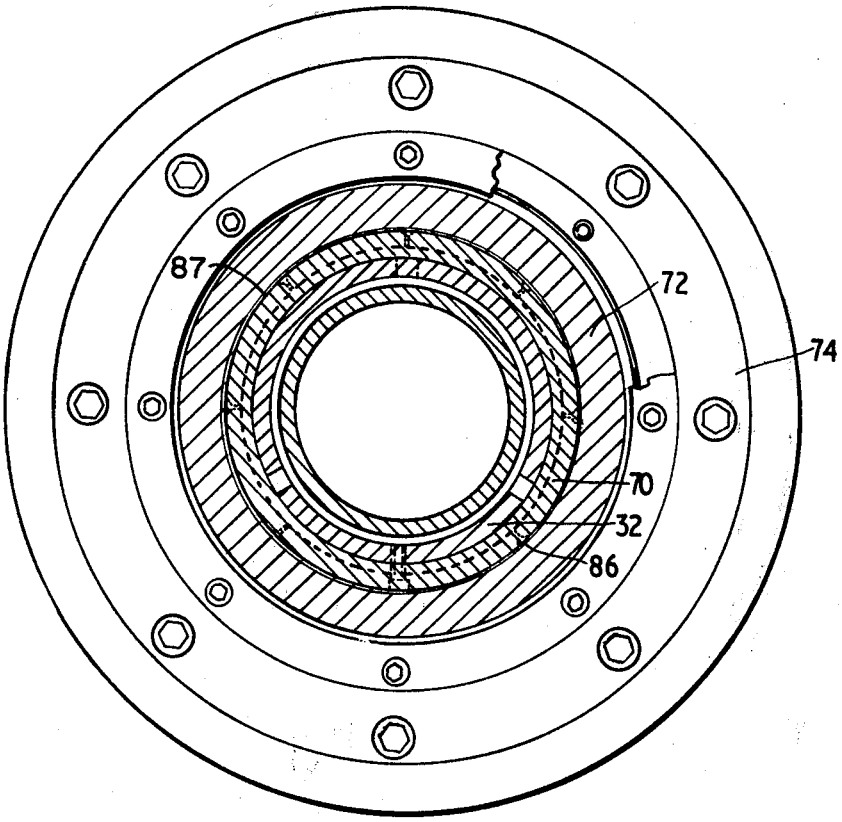
-FIG.5-

SCROLL DISCHARGE DECANTER CENTRIFUGES

The present invention concerns scroll discharge decanter centrifuges and more specifically fume tight decanters of the type in which the interior is blanketed by an inert gas at a pressure above the ambient atmospheric pressure.

In machines of this type, it is normally necessary to provide sealing arrangements between the rotating assembly and associated stationary outer casing. The sealing arrangement must be capable of ensuring that there is no ingress of air into the interior of the machine through the interface between rotary and stationary assemblies and that leakage of the inert gas blanket is reduced to an acceptable level.

To achieve an effective seal, it is conventional practice to employ known mechanical face seals in which the face of a stationary ring is maintained in intimate contact with a coaxial rotating ring by spring pressure. The seal is achieved at the interface of the two rings and it is necessary to ensure, in view of the high relative sliding velocity, that the material combination of the rings is compatible to prevent seizure and rapid wear. At high rotational speeds the heat generated at the sliding interface must be dissipated and for this purpose provision is made for the application of a copius flow of cooling liquid through the seal housing.

The major disadvantages of the conventional mechanical face seal are:

(i) Relatively expensive materials are required for the rings and these must be produced to a very accurate flatness tolerance.

(ii) The softer of the two rings has a limited life, wears and requires periodic replacement.

(iii) A copious supply of clean cooling fluid must be maintained through the seal housing.

(iv) High power losses are incurred due to the frictional drag arising from the seal contact faces.

A simpler known alternative solution utilises a labyrinth seal into which a flow of nitrogen is introduced. However, the large clearance between rotating and stationary parts of the labyrinth, which are necessary to ensure that metallic contact between the associated surfaces is prevented either through eccentricity between stationary and rotating members or deflections arising from the action of applied loads, generally results in a high flow of nitrogen being required. Since the flow through the labyrinth seal is proportional to the cube of clearance dimensions, large clearances result in very high nitrogen flow rates.

In accordance with the invention, in continuous centrifuges of the type in which the interior is to be kept sealed from the atmosphere, sealing is achieved between the rotating assembly and the stationary outer casing by means of a plurality of sealing devices effective between the rotary assembly and the stationary assembly, each of said sealing devices comprising a first ring fixed relative to the stationary assembly and a second, coaxial ring which is adapted to rotate with the rotary assembly, that surface of the first ring which faces the second ring containing a plurality of gas jet nozzles by way of which pressurized gas can be supplied to an annular clearance gap between the first and second rings, and one of said rings of each sealing device being sealed by means of one or more elastomer seals to a further annular member, which is stationary relative to that one ring, such that that ring is permitted to have a predetermined amount of radial and angular freedom relative to said further annular member for accommodating misalignment between the rotary and stationary assemblies.

Conveniently, the elastomer seals are in the form of respective O-rings.

Gas, preferably nitrogen, can conveniently be supplied to the jets in said one of the rings by way of passages in the stationary parts of the centrifuge, the arrangement being such that approximately half of the gas leaks into the interior of the centrifuge while the remainder leaks to the atmosphere.

With a seal in accordance with the present invention, the inherent disadvantages of the labyrinth seal arrangement are effectively eliminated and a seal having a small working clearance between rotating and stationary parts, irrespective of misalignment between the basic rotating and stationary assemblies, can be produced in which metallic contact between the associated surfaces is prevented and in which the blanketing gas leakage flow rate is reduced to a comparatively low value.

The invention is described further hereinafter, by way of example, with reference to the accompanying drawings, in which:

FIG. 5 is a section on BB of FIG. 4.

Figure 1:
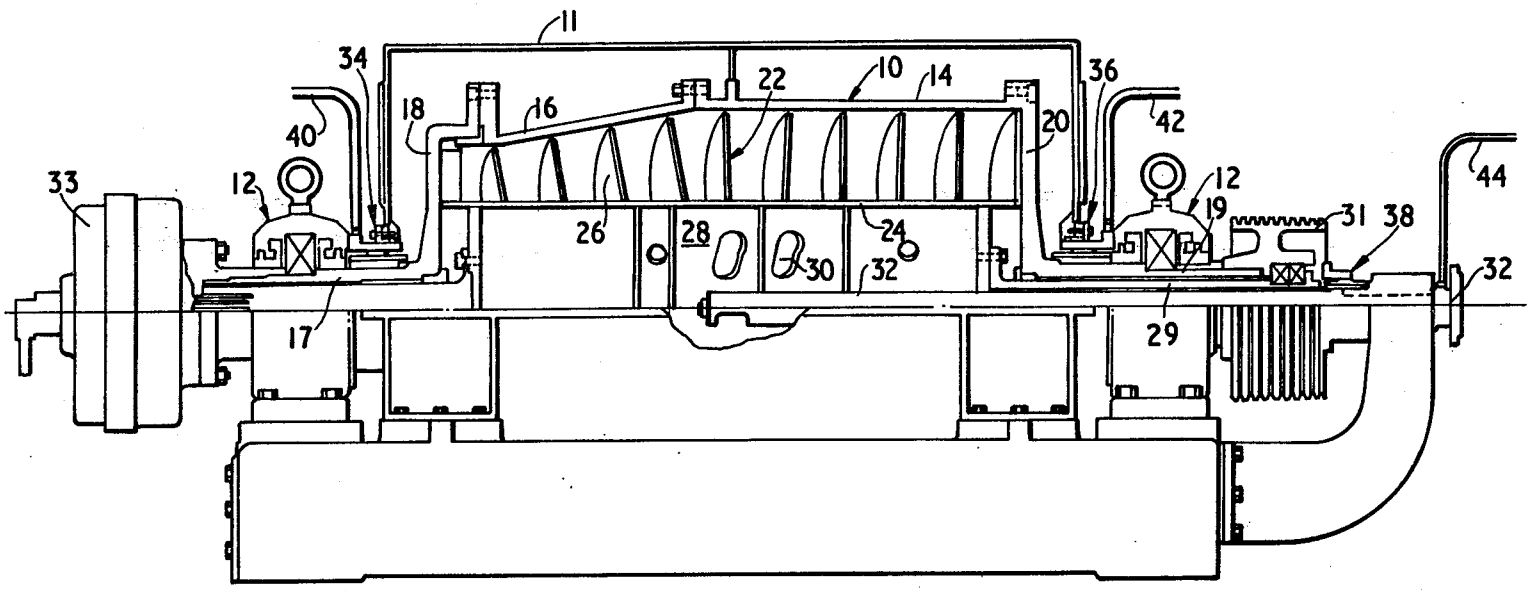
FIG. 1 is a partially cut-away side elevation of a complete scroll discharge decanter centrifuge fitted with sealing devices in accordance with the present invention.

FIG. 1 illustrates a typical scroll discharge decanter centrifuge embodying a number of sealing devices in accordance with the invention. The general construction of the centrifuge is conventional and includes a bowl 10 adapted to be rotated within a casing 11 in bearings 12 at a speed sufficient to generate the centrifugal effect desired. The bowl 10 has a cylindrical portion 14, a tapered portion 16, a pair of bowl heads 18 and 20 and trunnions 17 and 19 at each end, respectively, which are journalled in the bearings 12. Mounted within the bowl 10 is a screw conveyor 22 comprising a cylindrical hollow hub 24 carrying a helical conveyor 26. Within the hub 24 of the conveyor 22, there is formed a feed chamber 28 which communicates with the interior of the bowl through a plurality of apertures 30. A stationary feed pipe 32 communicates with the feed chamber 28, the feed pipe being located within a hollow trunnion shaft 29 of the conveyor 22. The bowl is adapted to be driven via a drive pulley 31. The conveyor assembly is also adapted to rotate at high speed but a differential speed is maintained relative to the bowl 10 by means of a gearbox 33.

Sealing is necessary at the outer casing 11 at both ends of the rotating assembly as indicated by the reference numerals 34 and 36 and also between the stationary feed pipe 32 and the rotating drive pulley 31 as indicated at 38. Nitrogen is supplied to each of the seals 34, 36, 38 by way of respective pipes 40, 42, 44 and leaks both into the interior of the centrifuge casing 11 and outwards to atmosphere.

Figure 2:
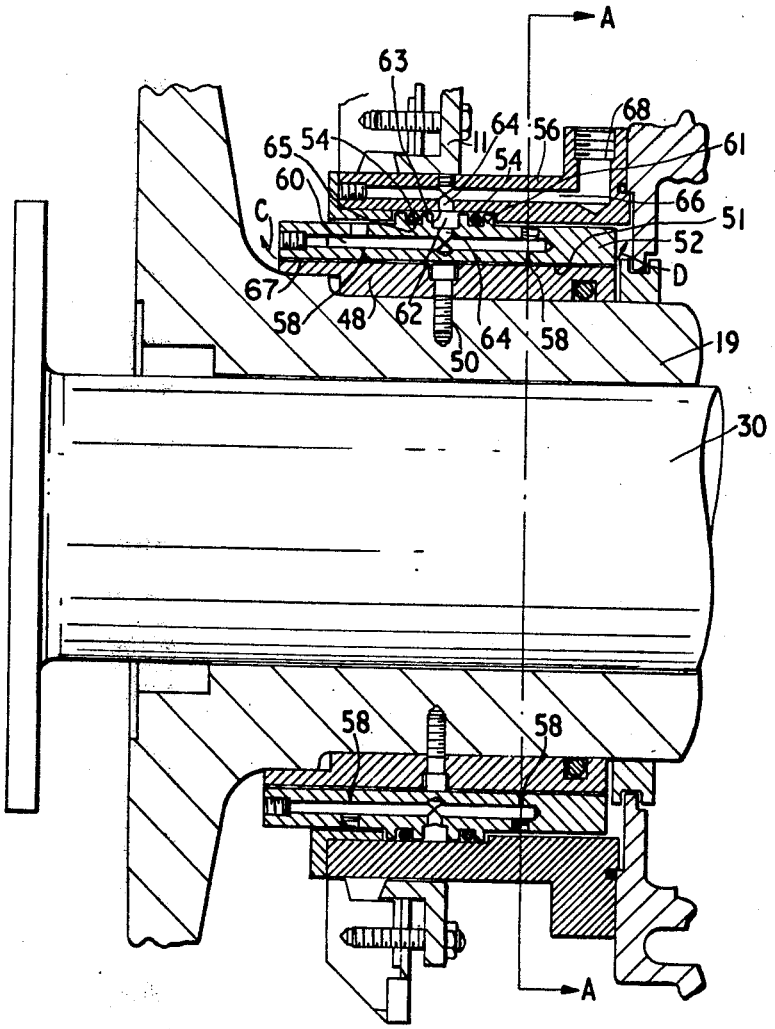
FIG. 2 is a sectional side elevation of one embodiment of a sealing device in accordance with the present invention.
Figure 3:
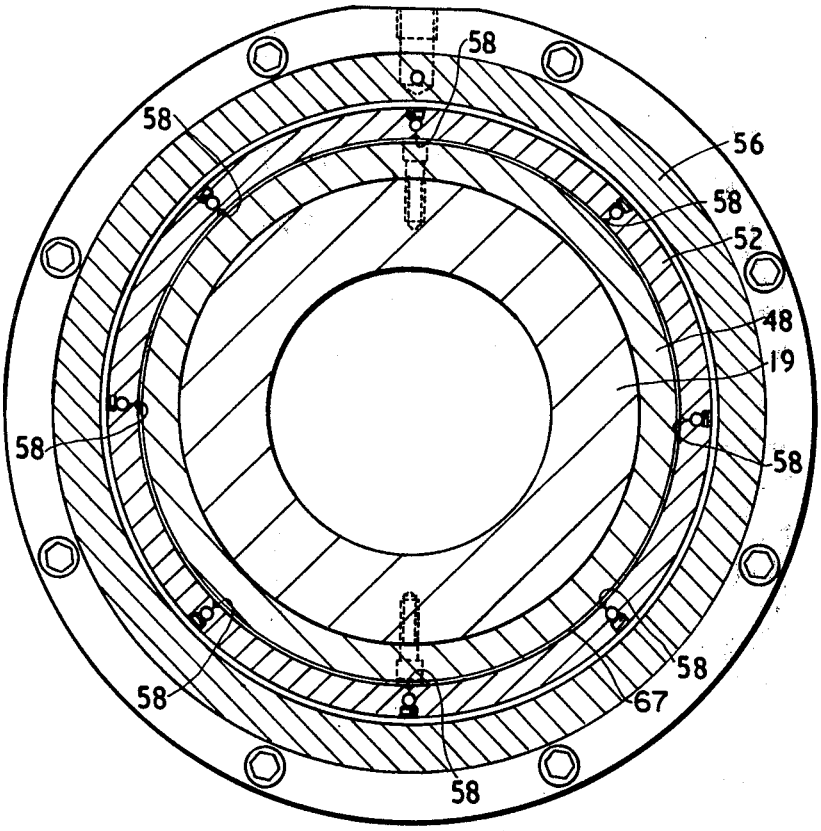
FIG. 3 is a section or AA of FIG. 2.

The casing seals 34 and 36 are identical, the seal 36 being illustrated in more detail in FIGS. 2 and 3. The seal basically comprises three parts, an inner ring 48 secured by bolts 50 to the bowl head extension shaft or trunnion 19 so that it rotates with the bowl 10, an outer stationary sealing ring 52 which is free to float on elastomer seals 54, and an outer seal housing 56 which axially locates the floating outer stationary sealing ring 52 and is coupled thereto by means of the seals 54. The outer floating stationary sealing ring 52 is lightly located by the elastomer seals 54 in a radial direction such as to permit and accommodate misalignment between the rings 48 and 52, both of a purely eccentric nature and angular misalignment relative to the rotational axis. For this purpose, the ring 52 has an annular projection 61 on its outer periphery which is loosely received in an annular slot 63 in the inner periphery of the member 56, the annular projection 61 itself having peripheral slots 65 containing the elastomeric seals 54 which engage the inner periphery of the slot 63 in the member 56. There is a predetermined radial clearance between the outer peripheral surface of the projection 61 and the inner peripheral surface of the slot 63 in the member 56. This determines the radial freedom of the outer ring 52 relative to the fixed housing 56. Furthermore, there is a predetermined axial clearance between the axial ends of the projection 61 and the adjacent axial end walls of the slot 63. The combination of the latter radial and axial clearances provide a predetermined angular freedom for the outer ring 52 relative to the fixed housing 56. The aforegoing radial and angular freedoms enable misalignment between the rotary and stationary assemblies to be accommodated.

The inner rotating ring 48 is thus maintained in a coaxial position relative to the outer stationary sealing ring 52 and is prevented from contacting the ring 52 by the gas supplied to the annular space 67 between these rings. The seal thus acts like a pressure fed gas bearing arrangement. The seal employs the same type of inert gas used for blanketing the interior of the casing 11, preferably nitrogen, substantially half of the gas leaking from the bearing into the interior of the casing 11 as indicated by the arrow C and the remainder leaking to atmosphere as indicated by the arrow D. The interior leakage effectively prevents the ingress of solvent vapours into the running clearance of the seal while the exterior leakage prevents the ingress of air into the nitrogen blanketed interior.

The arrangement for feeding gas to the seal comprises two or more axially spaced rows of feed jets 58 on the radially inner surface 51 of the stationary outer ring 52, each row comprising three or more angularly separated jets which are substantially equally spaced, as best seen in FIG. 3. The ring 52 includes a plurality of axially extending bores 60 which connect those jets which lie at the same angular position. The bores 60 are themselves connected to a common annular groove or channel 62 on the radially outer surface of the ring 52 by respective radially directed bores 64. The channel 62 is located opposite a similar channel 64 in the radially inner surface of the outer seal housing 56 which communicates via an axial bore 66 with a gas supply bore 68 connected to the gas supply pipe 42 (FIG. 1). Advantageously, the jets are located in rows disposed in planes located symmetrically about a radial plane through the centre of the annular member 52. By this means it can be arranged that approximately half of the gas supplied to the annular clearance gap 67 leaks into the interior of the centrifuge while the remainder leaks to the atmosphere.

The bearing part of the seal operates in a conventional manner for gas bearings, eccentricity between stationary and rotating parts reducing the clearance on one side of the bearing leading to an increase in pressure in this region with a corresponding increase in clearance and reduction in pressure on the diametrically opposite side. The increase and decrease in pressure in these regions results in a restoring force which serves to centralise the floating outer sleeve. This arrangement effectively maintains the outer stationary ring 52 substantially coaxial relative to the rotating ring 48 and prevents metallic contact between these rings 52 and 48.

It will be appreciated that this arrangement permits a relatively small clearance between stationary and rotating members to be employed, resulting in a very low flow rate of nitrogen in the bearing housing when compared with conventional non-floating labyrinth sealing systems. Furthermore, the power losses are very small compared with machines employing mechanical face seals and a supply of a cooling liquid is unnecessary.

Figure 4:
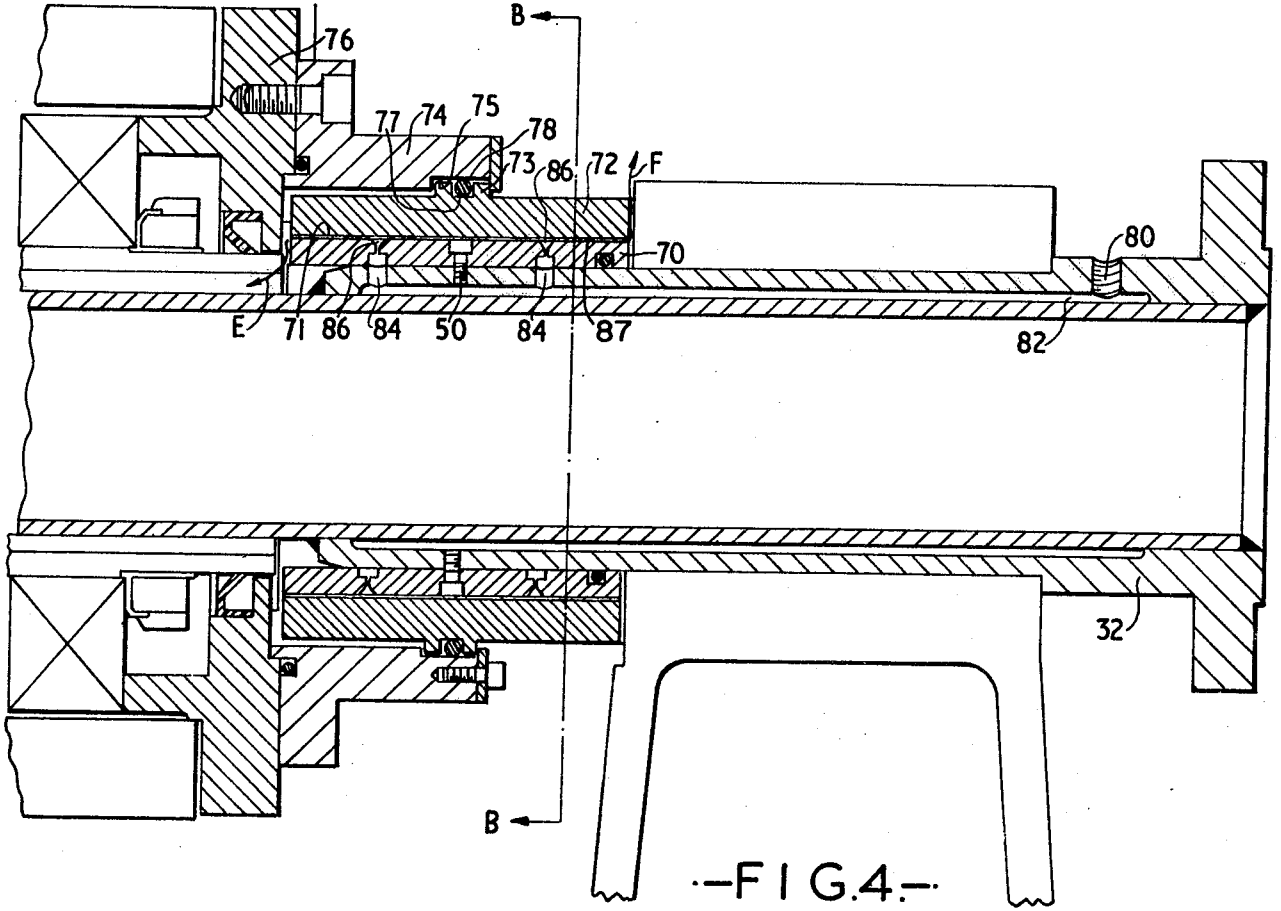
FIG. 4 is a sectional side elevation illustrating a sealing device in accordance with the invention for the feed pipe.

As illustrated in FIGS. 4 and 5, a similar sealing arrangement is used for sealing the feed pipe 32, the principal difference being that the inner portion of the seal is stationary while the outer part rotates. The feed pipe 32 has a sleeve 70 fixed to it so that this sleeve is stationary. An outer floating seal ring 72 surrounds the sleeve 70 with an annular clearance 87 therebetween and is axially located by an annular flange 74 attached to the bearing cap 76 which rotates with the bowl trunnion 19. The ring 72 has an annular projection 73 on its outer periphery which is loosely received in an annular slot 75 in the inner periphery of the member 74, the annular projection 73 itself having a peripheral slot 77 containing an elastomeric seal 78 which engages the inner periphery of the slot 75 in the member 74. The seal ring 72 is thereby radially located by the elastomer seal 78 which allows radial and angular misalignment between the rotary and stationary assemblies to be accommodated in the same manner as in the case of the sealing devices 34 and 36 described above.

Nitrogen is supplied to the bearing formed between the rotating seal ring 72 and the fixed sleeve 70 by way of a radial bore 80, an axially extending annular passage 82 and a plurality of further radial bores 84 in the feed pipe 32. The bores 84 communicate with two or more rows of jets 86 in the radially outer surface 71 of the fixed sleeve 70, each row comprising three or more jets arranged at angularly spaced positions around the circumference of the sleeve 70.

In use, the seal operates substantially identically to the seal of FIGS. 2 and 3. Substantially half the gas supplied to the seal leaks into the interior of the centrifuge casing as indicated by the arrow E and the remainder leaks to atmosphere as indicated by the arrow by virtue of the symmetrical arrangement of the rows of jets in relation to a central radial plane through the ring 70 F.

In a further embodiment, the floating outer stationary sleeve can be electrically isolated from the enclosing housing. This permits an electrical potential applied between the floating sleeve and ground to be employed to detect mechanical contact between rotary and stationary parts, the electrical signal being used to stop the machine and prevent damage occurring through seizure.

I claim:

1. In a scroll discharge decanter centrifuge of the type in which the interior of the centrifuge is to be kept sealed from the atmosphere, and which comprises a stationary assembly which includes an outer casing, a rotary assembly which includes a solid bowl which is adapted to be rotated within the stationary casing at a first speed and a scroll conveyor which is rotatable within the bowl at a second, slightly different speed, the improvement comprising a sealing device effective between the rotary assembly and the stationary assembly, said sealing device comprising a first ring fixed relative to the stationary assembly, a second, coaxial ring which rotates with the rotary assembly, a plurality of gas jet nozzles contained in that surface of said first ring which faces said second ring, said gas jet nozzles enabling pressurized gas to be supplied to an annular clearance gap between said first and second rings, a further annular member which is stationary relative to one of said rings, and elastomeric seal means sealing said one of said rings of said sealing device to said further annular member to permit said one of said rings to have a predetermined amount of radial and angular freedom relative to said further annular member for accommodating misalignment between the rotary and stationary assemblies.

2. A scroll discharge centrifuge according to claim 1, including passage means in the stationary assembly by which gas can be supplied to said nozzles, the nozzles being located where approximately half of the gas supplied thereby to said clearance gap leaks into the interior of the centrifuge while the remainder leaks to the atmosphere.

3. A scroll discharge centrifuge according to claim 1, comprising a trunnion at each end of the bowl which projects out of the stationary casing, and respective main bearings journalling said trunhions, and in which a respective one of said sealing devices is located between each trunnion and said stationary outer casing.

4. A scroll discharge centrifuge according to claim 3, in which said second rings of the sealing devices are rigidly fixed to the associated trunnions and said first rings are coupled to said stationary outer casing.

5. A scroll discharge centrifuge according to claim 3 in which the stationary assembly includes fixed pipework for introducing feed material into the interior of the bowl, said pipework comprising a stationary tube which extends through a coaxial bore in one of said bowl trunnions, and in which a further one of said sealing devices is located between said stationary tube and said one of the bowl trunnions.

6. A scroll discharge centrifuge according to claim 5, in which the first ring of said further sealing device is rigidly fixed to said stationary tube and the second ring is coupled to said one of the bowl trunnions for rotation therewith.

7. A scroll discharge centrifuge according to claim 1, including an annular projection on the outer periphery of said one ring, an annular slot in the inner periphery of said further annular member, said annular projection being loosely received in said annular slot, and at least one peripheral slot located in said annular projection and containing said elastomeric seal means, the seal means engaging the inner periphery of said slot in said further annular member.

* * * * *